US009653840B2

(12) United States Patent
Reinhardt et al.

(10) Patent No.: US 9,653,840 B2
(45) Date of Patent: May 16, 2017

(54) ELECTRICAL CONNECTOR

(71) Applicant: Tyco Electronics AMP GmbH, Bensheim (DE)

(72) Inventors: Marc Reinhardt, Bensheim (DE); Frank Flittner, Alsbach-Haehnlein (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/608,861

(22) Filed: Jan. 29, 2015

(65) Prior Publication Data

US 2015/0140852 A1 May 21, 2015

Related U.S. Application Data

(63) Continuation of application No. PCT/IB2013/055704, filed on Jul. 11, 2013.

(30) Foreign Application Priority Data

Jul. 13, 2012 (DE) ..... 10 2012 212 274

(51) Int. Cl.

| | |
|---|---|
| ***H01R 13/52*** | (2006.01) |
| ***H01R 13/504*** | (2006.01) |
| ***H01R 13/516*** | (2006.01) |
| *H01R 24/62* | (2011.01) |

(52) U.S. Cl.

CPC ..... *H01R 13/521* (2013.01); *H01R 13/504* (2013.01); *H01R 13/516* (2013.01); *H01R 13/5202* (2013.01); *H01R 13/5216* (2013.01); *H01R 24/62* (2013.01)

(58) Field of Classification Search

CPC ..... H01R 13/5216; H01R 13/5202; H01R 13/504; H01R 13/7057

USPC ..... 439/936, 589, 736, 607.58, 278, 447

See application file for complete search history.

(56) References Cited

U.S. PATENT DOCUMENTS

| | | | | |
|---|---|---|---|---|
| 4,413,875 A | | 11/1983 | Mattingly | |
| 4,927,388 A | | 5/1990 | Gutter | |
| 5,304,073 A | * | 4/1994 | Golobay | E21B 17/028 439/282 |

(Continued)

FOREIGN PATENT DOCUMENTS

CH WO 2007085099 A1 * 8/2007 ..... H01R 13/5219

OTHER PUBLICATIONS

PCT International Search for co-pending Application No. PCT/IB2013/055704, dated Nov. 21, 2013, 3 pages.

(Continued)

*Primary Examiner* — Abdullah Riyami
*Assistant Examiner* — Thang Nguyen
(74) *Attorney, Agent, or Firm* — Barley Snyder

(57) ABSTRACT

An electrical connector that includes a connector housing and a contact housing. The connector housing has a contact receiving space with a front opening and a rear opening and a sealing rib extending into the contact receiving space. The contact housing is disposed in the contact receiving space and abuts the sealing rib. An intermediate space, between the contact housing and the connector housing has a front portion and a rear portion being delimited by the sealing rib. An intermediate component is disposed in the rear portion of the intermediate space.

17 Claims, 7 Drawing Sheets

Fig. 1

(56) References Cited

U.S. PATENT DOCUMENTS 5,387,129 A 2/1995 Hotea
5,637,007 A * 6/1997 Suzuki ..... H01R 13/5216 439/276
5,906,513 A * 5/1999 Peterson ..... H01R 9/032 439/320
5,980,318 A * 11/1999 Morello ..... H01R 13/4226 439/595
6,508,671 B2 * 1/2003 Ko ..... H01R 13/6581 439/447
7,260,891 B2 8/2007 Padula
8,052,488 B2 * 11/2011 Ohki ..... H01R 13/5216 439/736
9,065,261 B2 * 6/2015 Kawamura ..... H01R 4/183
2005/0003708 A1 * 1/2005 Fukuda ..... H01R 13/5216 439/583
2005/0191899 A1 * 9/2005 Solano ..... H01R 13/521 439/519
2009/0215312 A1 * 8/2009 Deubel ..... H01R 13/5208 439/589
2010/0055954 A1 * 3/2010 Martin ..... H01R 13/5219 439/278
2010/0130076 A1 * 5/2010 Shrum ..... H01R 13/5216 439/863
2010/0136817 A1 * 6/2010 Schulze ..... H01R 13/622 439/339
2010/0258157 A1 * 10/2010 Arai ..... H01R 13/52 136/244
2011/0028036 A1 * 2/2011 Sakamaki ..... H01R 4/185 439/589
2011/0117780 A1 * 5/2011 Ishida ..... H01R 13/42 439/589
2014/0051286 A1 * 2/2014 Itsuki ..... H01R 13/533 439/587

OTHER PUBLICATIONS

PCT International Preliminary Report on Patentability and Written Opinion for co-pending Application No. PCT/IB2013/055704, dated Nov. 21, 2013, 8 pages.

* cited by examiner

ELECTRICAL CONNECTOR

CROSS-REFERENCE TO RELATED APPLICATIONS

This application is a continuation of PCT International Application No.: PCT/IB2013/055704 filed Jul. 11, 2013, which claims priority under 35 U.S.C. §119 to German Patent Application 102012212274.5, filed Jul. 13, 2012.

FIELD OF THE INVENTION

The invention relates to an electrical connector and, more particularly, to an electrical connector having an intermediate component positioned between a contact housing and a connector housing.

BACKGROUND

U.S. Patent Application Publication No. 2006/0154516 A1 describes a known electrical connector made from injection molded plastic in order to reliably secure electrical wires with a housing of the known electrical connector. In addition to the mechanical connection, the injection molding process also provides reliable sealing with respect to moisture. To this effect, an inner space of the housing is filled with a plastic to seal the inner space. For instance, plastic may be injected from a rear side of the housing and about an electrical wire positioned in an inner space of the housing. Though, a contact region, arranged on a front side of the connector, is not filled with the plastic. Rather, sealing elements are provided in the contact region. The sealing elements seal a space between the electrical wires and the housing so that the plastic cannot flow from a rear region into the front insertion region.

European Patent No. EP 2 348 585 A2 discloses a known cable connector in which the electrical wires are inserted into a connector housing of the cable connector and sealing elements are subsequently inserted between the electrical wires and the connector housing. Then, plastic is subsequently injected from a rear side and into an intermediate space between the connector housing and the cable. The sealing elements prevent the plastic from reaching a front insertion region.

SUMMARY

An object of the invention, among others, is to provide an improved electrical connector whose housing is sealed with a material.

Accordingly, an electrical connector according to the invention is provided. The electrical connector includes a connector housing and a contact housing. The connector housing includes a contact receiving space with a front opening and a rear opening and a sealing rib extending into the contact receiving space. The contact housing is disposed in the contact receiving space and abuts the sealing rib. An intermediate space is formed between the contact housing and the connector housing and includes a front portion and a rear portion being delimited by the sealing rib. An intermediate component is disposed in the rear portion of the intermediate space.

BRIEF DESCRIPTION OF THE DRAWINGS

The invention is explained in greater detail below with reference to the Figures, in which:

FIG. 7 is a sectional perspective view of the connector housing assembled with the contact housing and having an intermediate component injected there between;

DETAILED DESCRIPTION OF THE EMBODIMENT(S)

Figure 1:
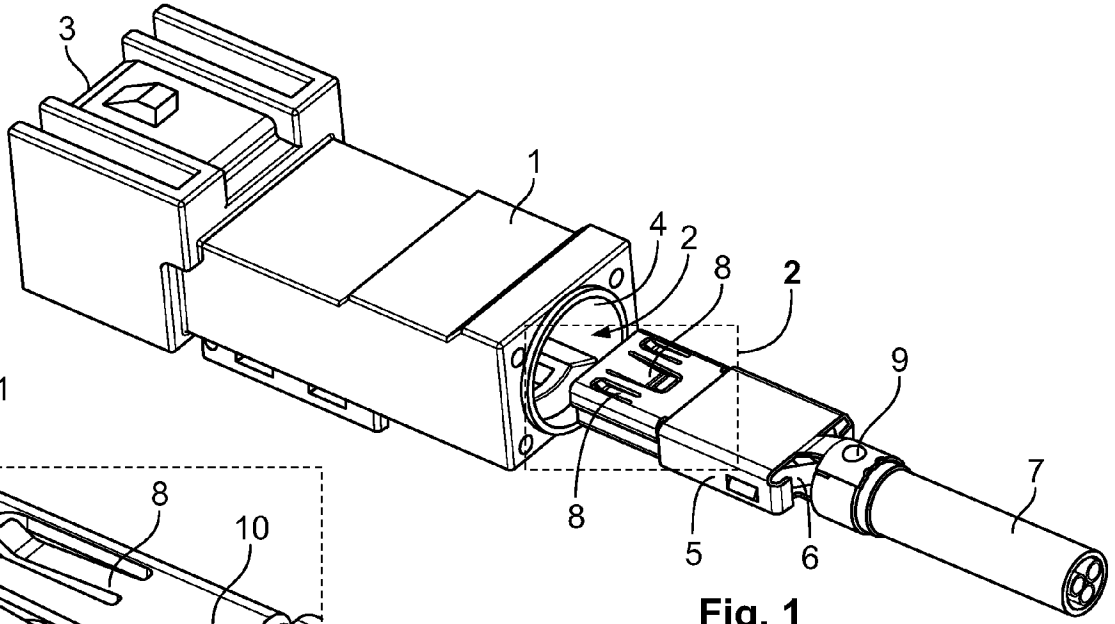
FIG. 1 is a perspective view of a connector according to the invention.

Now with reference to FIG. 1, a connector housing 1 according to the invention is shown. The connector housing 1 has a rear opening 4 and a contact receiving space 2 formed in the connector housing 1. In addition, the connector housing 1 a front opening 3 (not shown in FIG. 1). The connector housing 1 is produced from an electrically insulating material, for example, a synthetic material and, in particular, a plastic material.

FIG. 1 also shows a contact housing 5 which is arranged in front of the rear opening 4. The contact housing 5 is connected to electrical wires 6 of a cable 7. The electrical wires 6 are connected to non-visible electrical contacts of the contact housing 5. The cable 7 is secured to the contact housing 5 by means of a tension relief means 9 formed on the contact housing 5.

Figure 2:
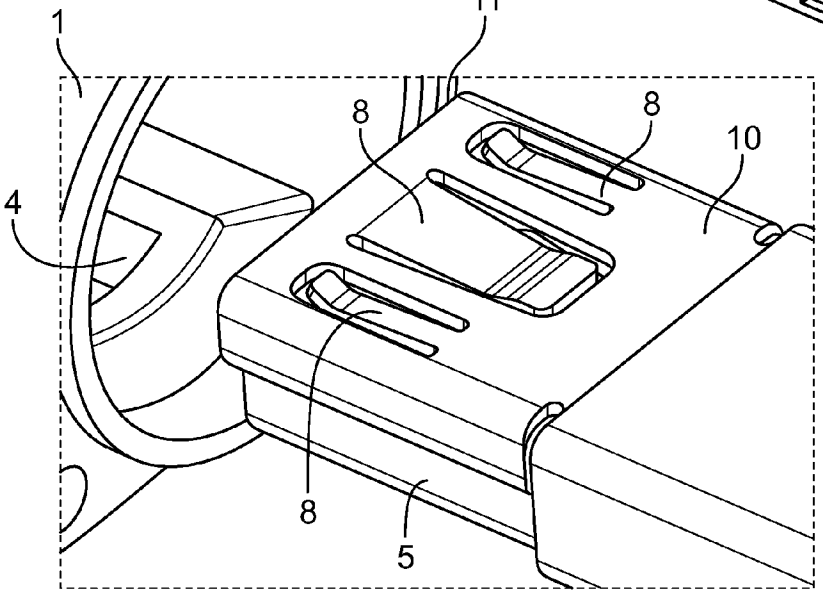
FIG. 2 is an enlarged view of a contact housing of the connector of FIG. 1.

Furthermore, the contact housing 5 is produced from an electrically conductive material, for example, a metal sheet. As shown in FIG. 2, the contact housing 5 includes three resilient contact sections along an upper side wall 10 thereof. The resilient contact sections 8 are constructed as portions of the upper side wall 10. The resilient contact sections 8 serve to make electrical contact with another connector inserted into the contact housing 5.

With reference to FIG. 2, the resilient contact sections 8 are clearly shown. When a contact is inserted, the resilient contact sections 8 move upward and away from the upper side wall 10. In the shown embodiment, the contact housing 5 includes three resilient contact sections 8, which includes a central resilient contact section being wider than the outer resilient contact sections. In addition, a free end of the central resilient contact section extends towards a center of the contact housing 5, and the free ends of the lateral resilient contact sections 8 extend in an opposite direction towards a front edge 11 of the contact housing 5.

Figure 3:
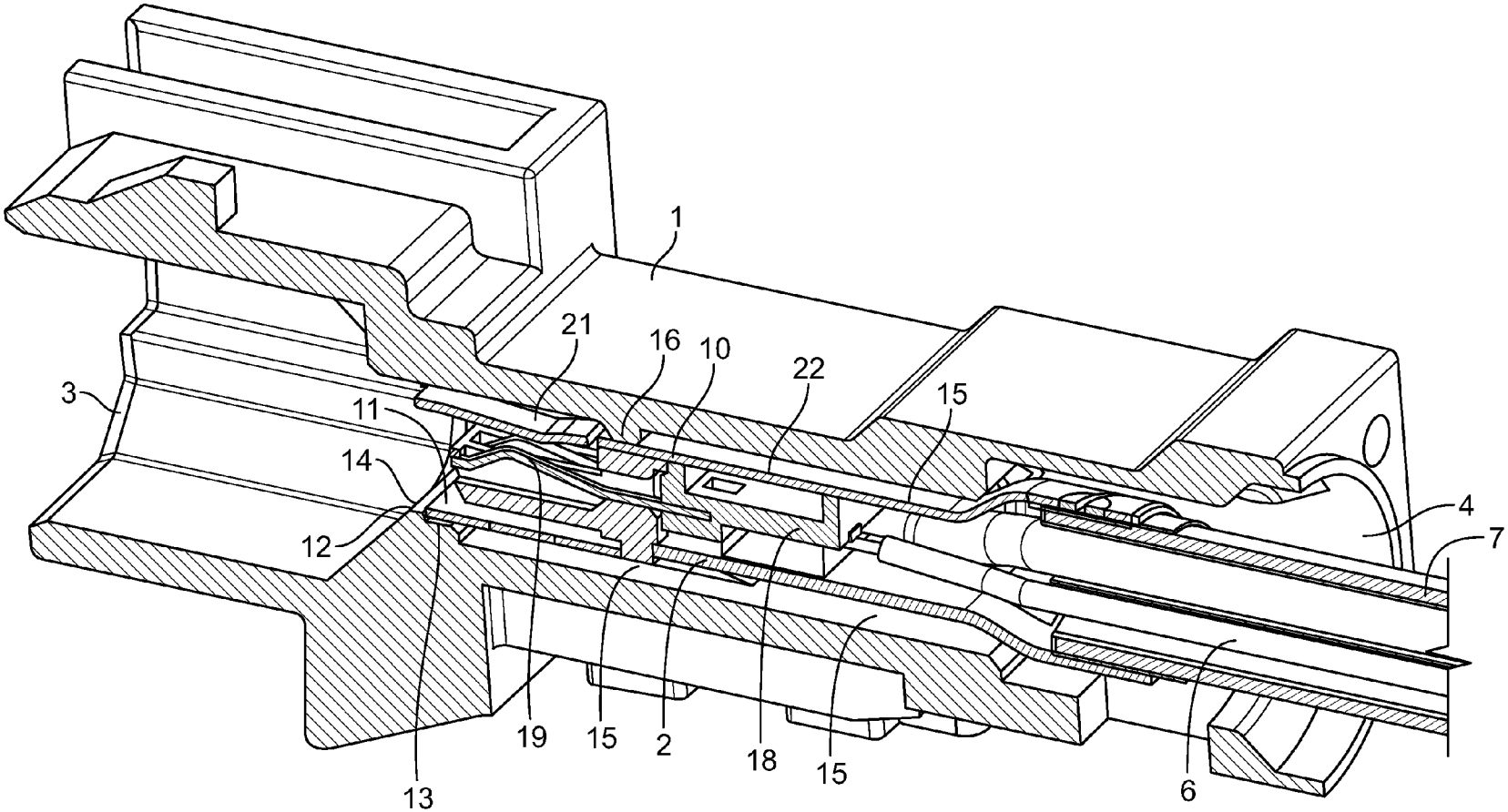
FIG. 3 is a sectional perspective view of the contact housing inserted into a connector housing of the connector according to the invention.
Figure 4:
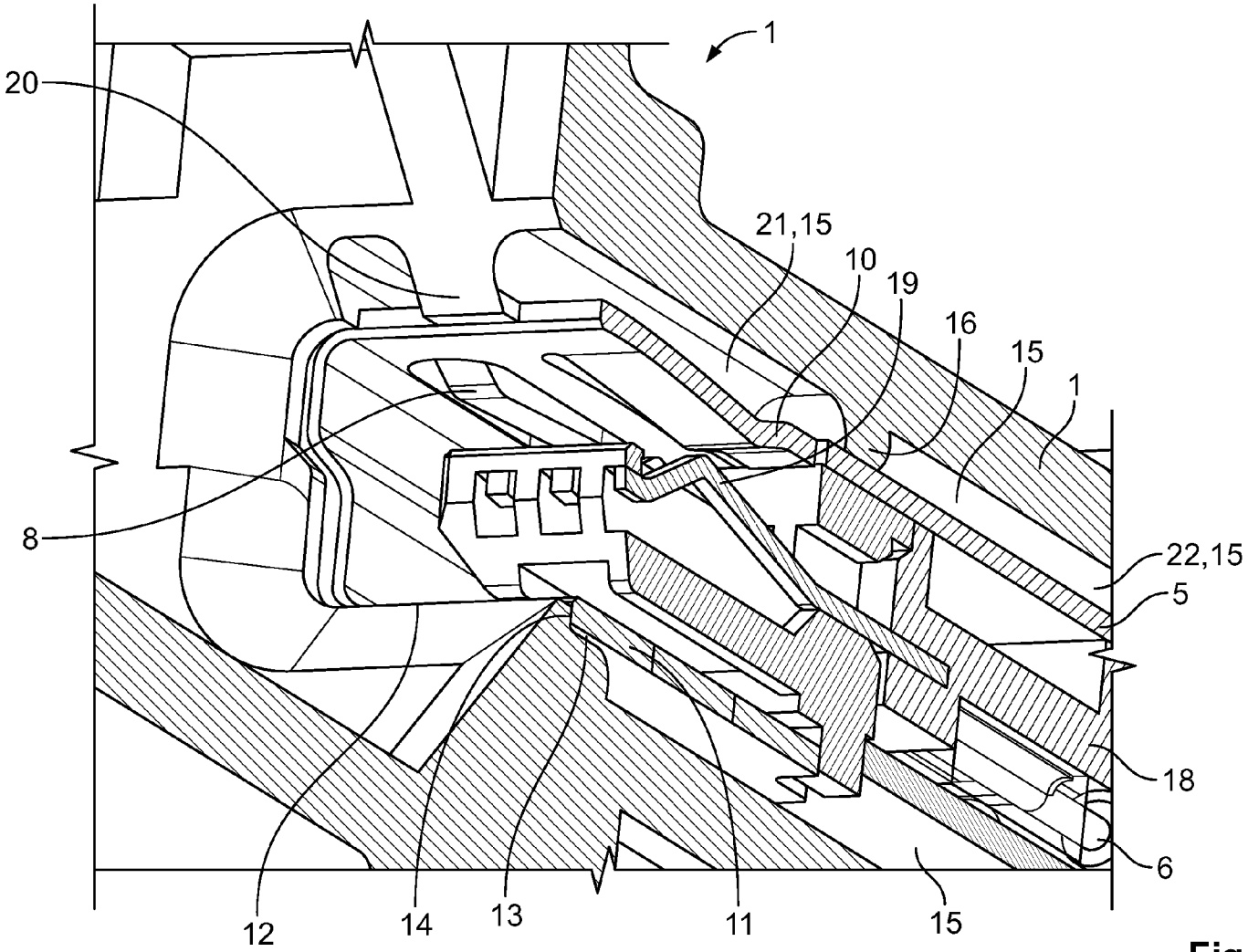
FIG. 4 is a partial cross-sectional view of an upper region of the contact housing.

Now with respect to FIGS. 3 and 4, the contact receiving space 2 of the connector housing 1 is shown. The contact housing 5 is positioned in contact receiving space 2 when assembled with the connector housing 1. A front edge 11 of the contact housing 5 is guided through the contact receiving space 2, as far as a contact edge 12 of the front opening 3. The contact edge 12 includes a lower inner abutment face 13 on which a lower part-region of the front edge 11 of the contact housing 5 rests. In addition, the contact edge 12 includes an outer abutment face 14, which the front edge 11 of the contact housing abuts at the end face. During assembly, the contact housing 5 is secure. The contact edge 12 also includes lateral front abutment faces which lateral portions of the front edge 11 of the contact housing 5 abut at the end face.

The contact housing 5 rests on guide rails (not shown) and is spaced from the connector housing 1 in the contact receiving space 2. Consequently, an intermediate space 15 is formed between the connector housing 1 and the contact housing 5 along four sides of the contact housing 5. The connector housing 1 also includes a sealing rib 16 which abuts an upper side wall 10 of the contact housing 5. The sealing rib 16 includes a web which is formed on an inner side of the connector housing 1. The sealing rib 16 separates a front portion 21 of the intermediate space 15 from a rear portion 22 of the intermediate space 15. The rear portion 22 of the intermediate space 15 is to be filled with a material and, in particular a molding material, such as, for example, a PVC, a hot-melt adhesive or a plastic.

As shown in FIG. 3, a retention element 18 for electrical contacts 19 is arranged inside the contact housing 5. The electrical contacts 19 are connected to conductors of the electrical wires 6. The electrical contacts 19 are directed towards the front opening 3 of the connector housing 1 in order to contact an electrical contact of the mating connector. Inside the contact housing 5, a sealing material may be applied between the contact 19 and a connection side through which the lines are supplied. Hence, the sealing material seals an inner space of the contact housing 5 with respect to moisture or dirt, while also serving to secure the cable. The contact housing 5 may, for example, be a USB connector and, in particular, a mini-USB connector.

Now with respect to FIG. 4, the contact edge 12 of the connector housing 1 can be seen in abutment with the front edge 11 of the contact housing 5. A contact edge 12 of the front opening 3 is not constructed in a continuous manner, but instead there are provided only support projections 20, only one of which can be seen in FIG. 4. An upper portion of the front edge 11 is in abutment with the support projection 20. As clearly shown in FIG. 4, a lower region of the front edge 11 abuts against the lower inner abutment face 13. In addition in FIG. 4, delimitation between the front portion 21 and the rear portion 22 by the sealing rib 16 can be seen. Furthermore, the arrangement of the resilient contact sections 8 in the region of the front portion 21 can be seen. As shown, the intermediate space 15 between the connector housing 1 and the contact housing 5 is also not yet filled with a material.

Figure 5:
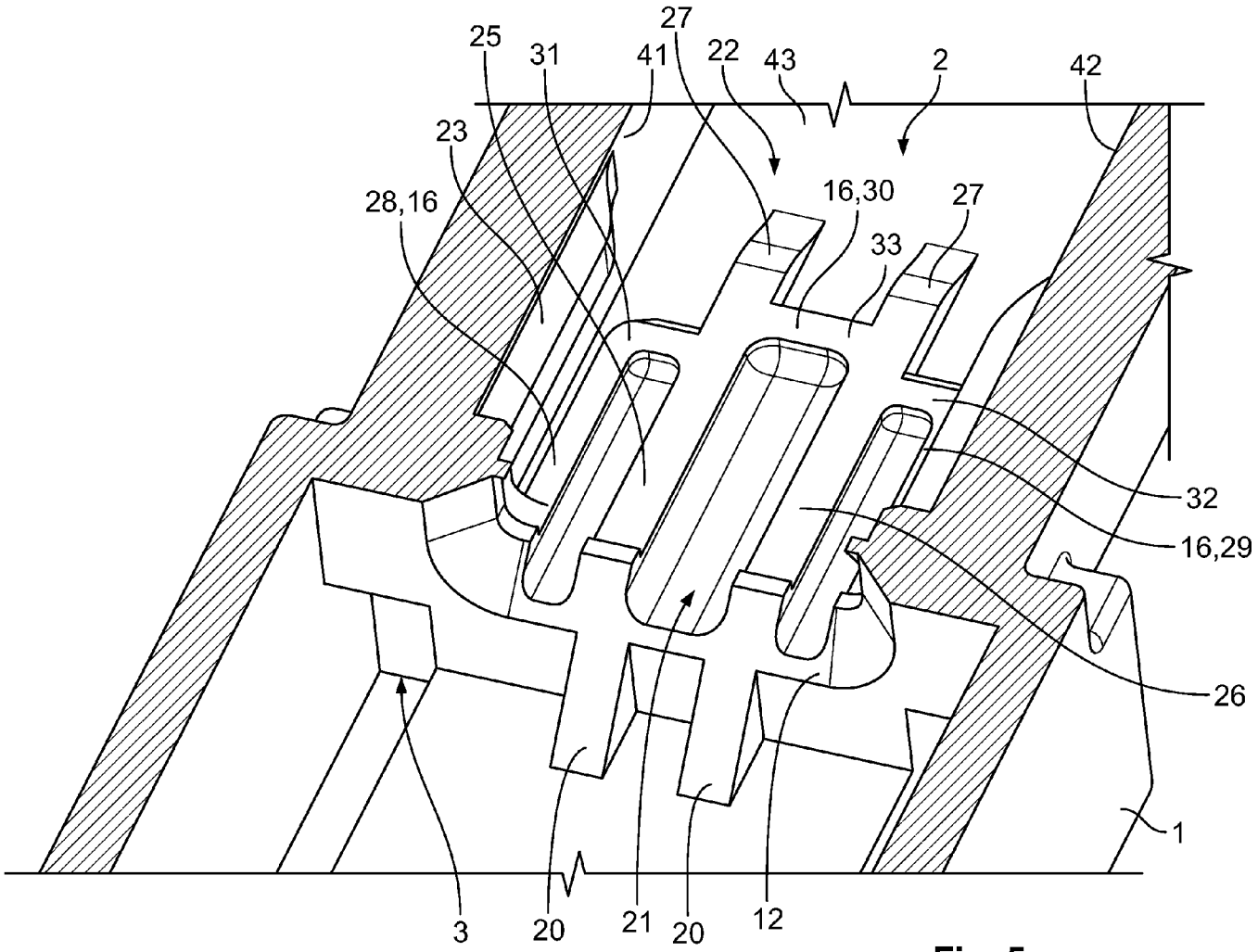
FIG. 5 is a partial cross-sectional view of an upper region of the connector housing.

With reference to FIG. 5, an inner upper side 43 of the connector housing 1 is shown and delimits the contact receiving space 2. Two support projections 20 can be seen in the region of the front opening 3. In addition, a first and a second guide rail 23, 24 are arranged at opposing side faces 41, 42 of the contact receiving space 2. In FIG. 5, only the first-guide rail 23 is visible. The first and the second guide rails 23, 24 position the contact housing 5. In addition, a third and fourth guide rail 25, 26 are arranged along the upper side of the contact receiving space 2. The third and fourth guide rails 25, 26 are arranged parallel with each other and extend parallel with the side faces 41, 42 of the contact receiving space 2.

The third and fourth guide rails 25, 26, in an initial portion 27, have a thickness that increases along the contact receiving space 2 in a direction towards the front opening 3. The sealing rib 16 is further formed on the upper side 43 of the contact receiving space 2. In the shown embodiment, the sealing rib 16 is constructed in a substantially U-shaped manner. The sealing rib 16 includes two portions 28, 29 that are arranged in parallel and along opposite sides of the upper side of the contact receiving space 2. The two portions 28, 29 are guided as far as the contact edge 12 of the front opening 3. The two portions 28, 29 are connected to each other in a rear region through a third sealing portion 30 which is transversely arranged thereof. In the shown embodiment, the third sealing portion 30 is constructed in a stepped manner, edges 31, 32 being arranged closer to the front opening 3 than a central part portion 33. Depending on the embodiment selected, the third portion 30 may also be constructed in the form of a continuous straight line. In addition, in the shown embodiment, the third and fourth guide rails 25, 26 correspond with the sealing rib 16 as far as the front portion 21 and as far as the support projections 20. The provision of the third and fourth guide rails 25, 26 in the front portion 21 provides increased stability for the contact housing 5.

Depending on the embodiment selected, it is possible to dispense with the formation of the third and fourth guide rails 25, 26 inside the sealing rib 16. In addition, in another embodiment, the sealing rib 16 may also be constructed as an annularly extending rib which is formed on all four sides of the contact receiving space 2. In another embodiment, the sealing rib 16 may be constructed in such a manner that the first and the second portions 28, 29 are arranged on the opposing side faces 41, 42 of the connector housing 1.

In the shown embodiment of FIG. 5, the front portion 21 is formed only on the inner upper side 43 of the connector housing 1 and consequently only on an upper side wall of an assembled contact housing. Depending on the sealing rib 16 selected, the front portion 21 may also be formed along the side faces 41, 42 of the contact housing 5 or on all four inner sides of the contact housing 5. The smaller the front portion 21 is, the better the sealing and the mechanical securing of the contact housing 5 in the connector housing 1 become. This is the case because the rear portion 22 is filled with a material and the material hardens to form an intermediate component between the connector housing 1 and the contact housing 5.

Figure 6:
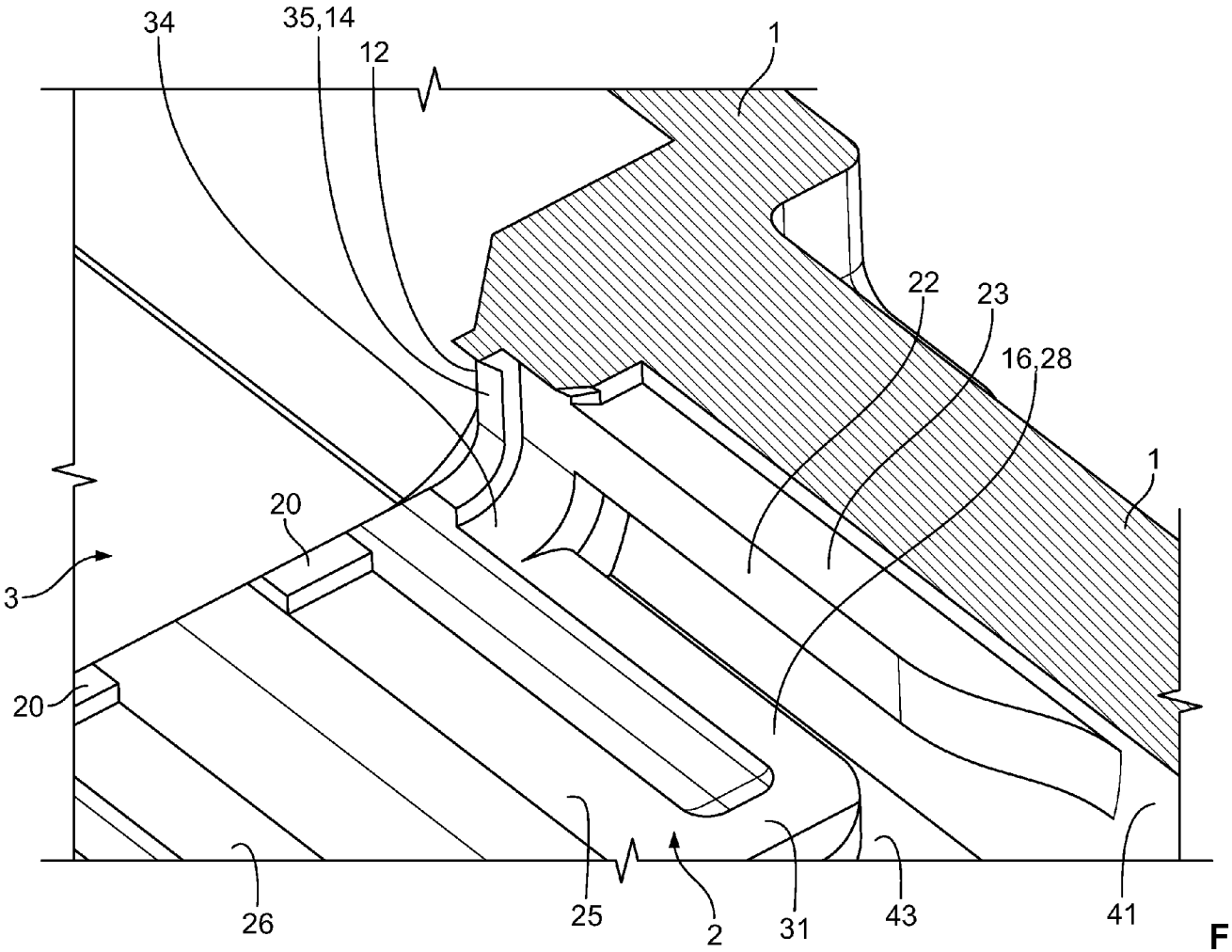
FIG. 6 is another partial cross-sectional view of the upper region of the connector housing.

As shown in FIG. 6, the first guide rail 23 is formed and extends as far as the contact edge 12 along the first side face 41 of the connector housing 1. An edge sealing rib 34 is formed between the second portion 29 of the sealing rib 16 and a front end of the first guide rail. The edge sealing rib extends from the sealing rib 16 as far as the second guide rail 24. In the shown embodiment, the edge sealing rib 34 has a rounded inner contour to which a rounded outer contour of a corner region of the contact housing is adapted so that relatively little intermediate space is provided between the edge sealing rib 34 and the corner region of a mounted contact housing. The rear portion 22 is formed adjacent to the edge sealing rib 34. Resulting from the edge sealing rib 34, improved sealing of the rear portion 22 is achieved. Additionally, material which is introduced about the rear portion 22 cannot flow or can flow only insignificantly in the direction towards the front opening 3 resulting from a narrow gap between the edge sealing rib 34 and the contact housing 5. A corresponding edge sealing rib is also formed symmetrically along the opposite side. As shown in FIG. 6, an edge 35 of the outer abutment face 14 is provided to which a corner region of the contact housing 5 abuts. The edge 35 is constructed in a curved manner around the corner portion between the inner upper side 43 and the first side face 41 of the connector housing 1.

Figure 7:
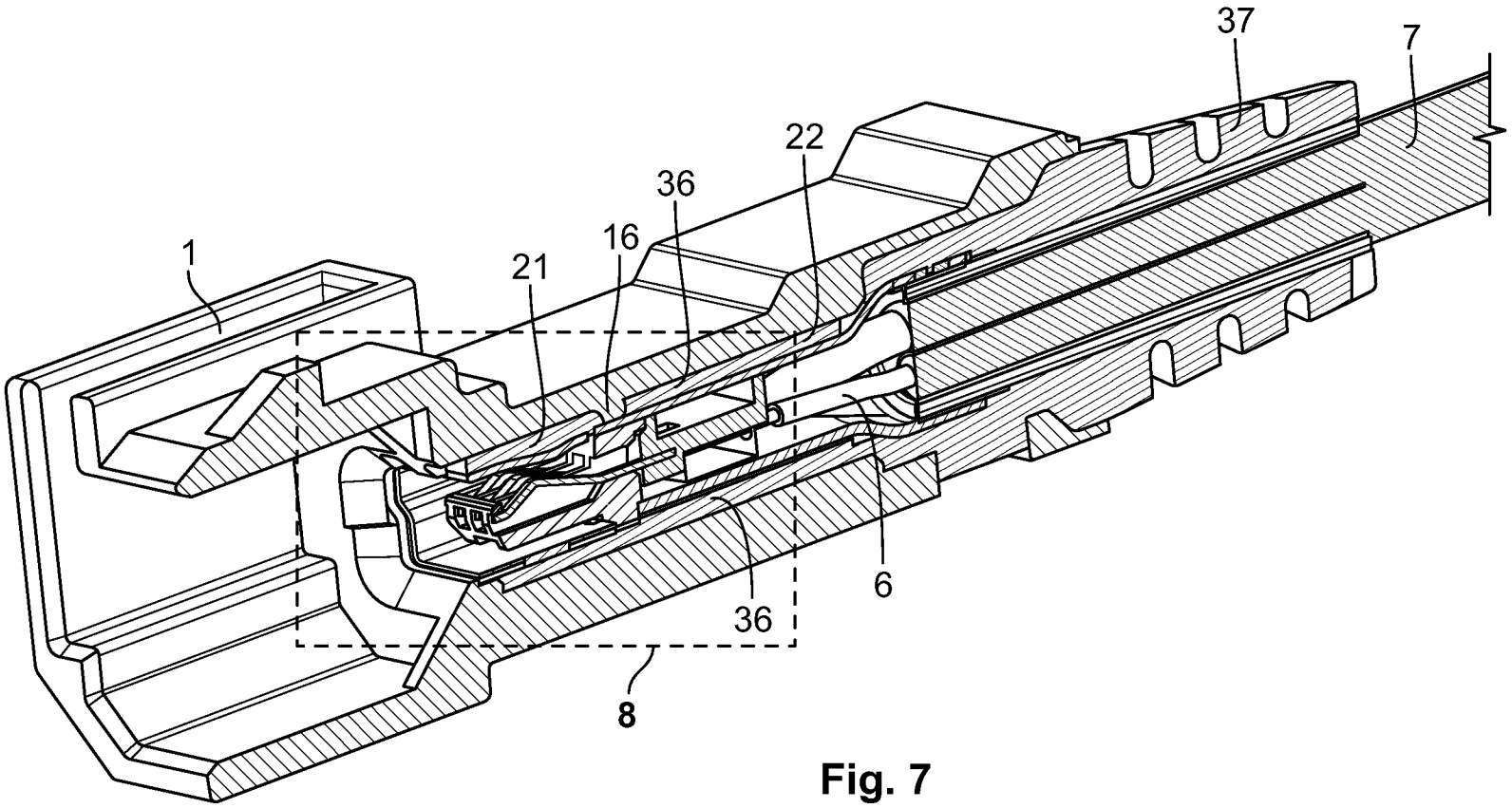

In order to produce the connector, in the arrangement of FIG. 3, material is then introduced from the rear and, in particular, injected from the rear. As a result, the material is positioned in the rear portion 22 of the intermediate space 15 between the contact housing 5 and inner walls of the connector housing 1. The contact receiving space 2 is filled from the rear side and a reinforcement portion 37, shown in FIG. 7, is formed in the region of the rear opening 4 of the connector housing 1 and the cable 7. The reinforcement portion 37 ensures that the cable cannot be excessively bent and cannot be damaged in the region of the rear opening 4.

Figure 8:
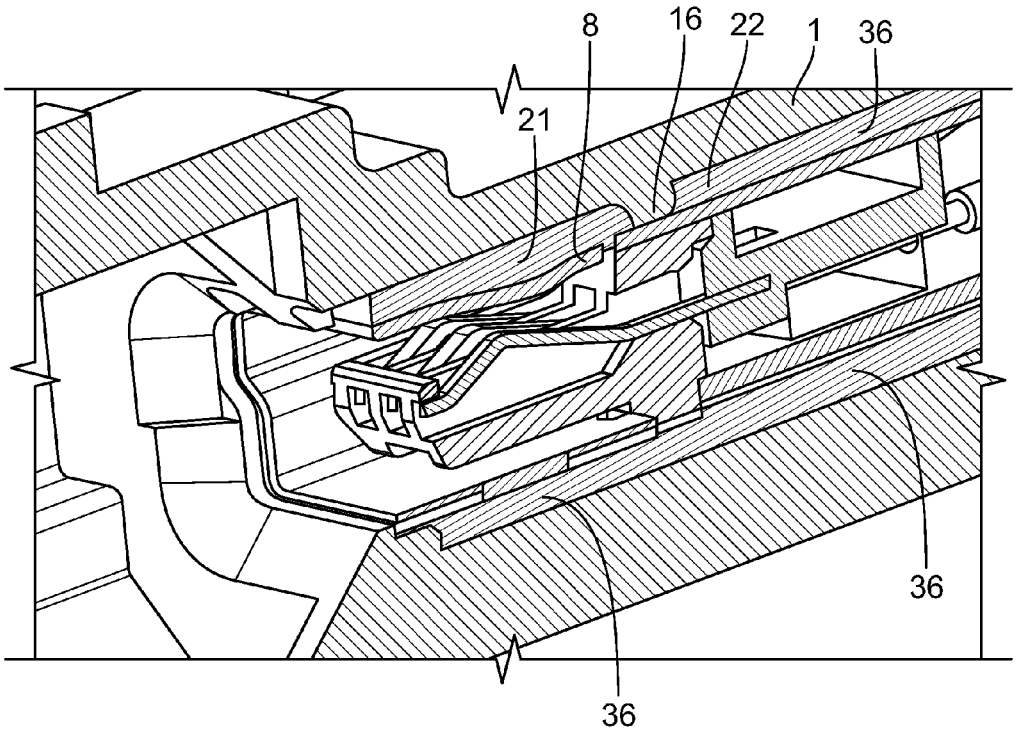
FIG. 8 is an enlarged sectional view of the connector housing and the contact housing of FIG. 7.

As shown in FIG. 7, the connector is filled with material that hardens to form an intermediate component 36. The intermediate component 36 is formed in the rear portion 22 of the intermediate space and also in an additional region of the rear opening 4 of the contact receiving space 2. The contact housing 5 is filled with the additional material so that the material cannot enter the region of the contacts 19 in the contact housing 5. FIG. 8 clearly shows that the intermediate component 36 terminates at the sealing rib 16 and the front portion 21 is free from any material.

Figure 9:
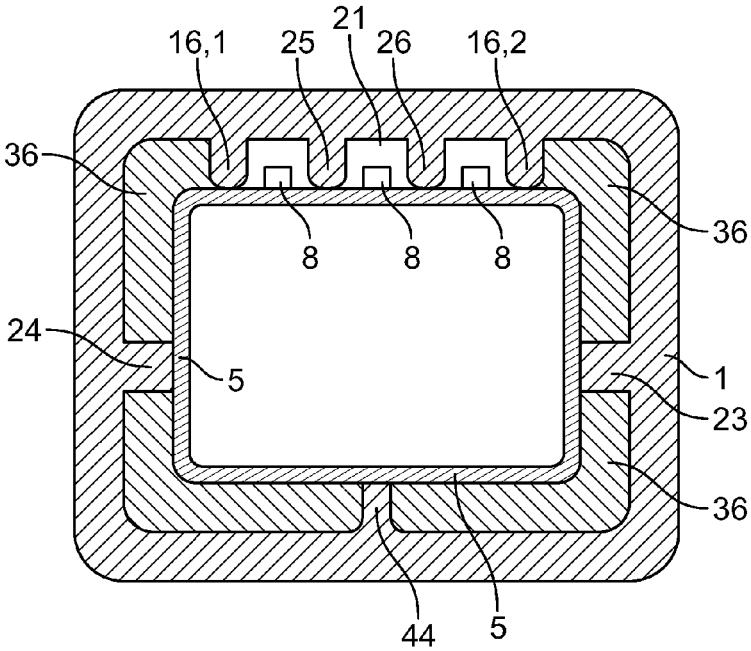
FIG. 9 is a cross-sectional view of the connector housing and the contact housing of FIG. 7.

As shown in FIG. 9, the intermediate component 36 is in abutment with the contact housing 5 along lower and lateral regions thereof. Since material is not introduced along the front portion 21, the intermediate component 36 is not present above the upper side of the contact housing 5 in the region of the resilient contact sections 8, and as a result, the contact housing 5 is reliably secured in the connector housing 1. As a result, the intermediate component seals the connector with respect to dust, moisture and dirt. As shown, another guide rail 44, on which the contact housing 5 rests, is positioned along a lower inner side of the connector housing 1.

In the embodiment shown, the contact housing 5 includes a metal shielding housing for a USB socket. Depending on the embodiment selected, however, any other type of contacts or connectors can be used. On account of the intermediate component 36, sealing and packing of the connector housing 1 with respect to the contact housing 5 at the rear side of the contact housing is achieved.

Although exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector comprising:

a connector housing having a contact receiving space with a front opening and a rear opening and a sealing rib extending into the contact receiving space;

a contact housing disposed in the contact receiving space and abutting the sealing rib, the contact housing including a resilient contact section on a side wall thereof;

an intermediate space formed between the contact housing and the connector housing and having a front portion and a rear portion delimited by the sealing rib; and an intermediate component disposed in the rear portion of the intermediate space.

2. The electrical connector according to claim 1, wherein the resilient contact section extends into the intermediate space when a mounting contact is connected to the electrical connector.

3. The electrical connector according to claim 2, wherein the resilient contact section is in the front portion of the intermediate space.

4. An electrical connector comprising:

a connector housing having a contact receiving space with a front opening and a rear opening and a sealing rib extending into the contact receiving space;

a contact housing disposed in the contact receiving space and abutting the sealing rib, the contact housing including a first side wall having a front section and a rear section, the sealing rib delimiting the front section of the first side wall from the rear section of the first side wall;

an intermediate space formed between the contact housing and the connector housing and having a front portion and a rear portion delimited by the sealing rib; and an intermediate component disposed in the rear portion of the intermediate space.

5. The electrical connector according to claim 4, wherein the sealing rib rests on the first side wall of the contact housing.

6. The electrical connector according to claim 5, wherein the sealing rib of the connector housing is U-shaped.

7. The electrical connector according to claim 6, wherein the sealing rib of the connector housing has a pair of free ends corresponding with a front lateral edge of the first side wall of the contact housing and that faces the front opening of the contact receiving space of the connector housing.

8. An electrical connector comprising:

a connector housing having a contact receiving space with a front opening and a rear opening and a sealing rib extending into the contact receiving space, the front opening including an edge;

a contact housing disposed in the contact receiving space and abutting the sealing rib;

an intermediate space formed between the contact housing and the connector housing and having a front portion and a rear portion delimited by the sealing rib; and an intermediate component disposed in the rear portion of the intermediate space.

9. The electrical connector according to claim 8, wherein the edge of the contact receiving space of the connector housing includes an inner abutment face on a lower side thereof.

10. The electrical connector according to claim 9, wherein the contact housing includes a front edge resting on the inner abutment face of the edge of the contact receiving space of the connector housing.

11. The electrical connector according to claim 10, further comprising a pair of outer abutment faces opposite lateral sides of the edge.

12. The electrical connector according to claim 11, wherein the front edge of the contact housing abuts the pair of outer abutment faces.

13. The electrical connector according to claim 12, further comprising an edge sealing rib positioned adjacent to the pair of outer abutment faces and extending to an upper edge of the connector housing.

14. An electrical connector comprising:

a connector housing having a contact receiving space with a front opening and a rear opening and a sealing rib extending into the contact receiving space;

a contact housing disposed in the contact receiving space and abutting the sealing rib, the contact housing having a lower face and a pair of side faces;

an intermediate space formed between the contact housing and the connector housing and having a front portion and a rear portion delimited by the sealing rib; and an intermediate component disposed in the rear portion of the intermediate space abutting the lower face and the pair of side faces of the contact housing.

15. An electrical connector comprising:

a connector housing having a contact receiving space with a front opening and a rear opening and a sealing rib extending into the contact receiving space;

a contact housing disposed in the contact receiving space and abutting the sealing rib;

an intermediate space formed between the contact housing and the connector housing and having a front portion and a rear portion delimited by the sealing rib; and an intermediate component disposed in the rear portion of the intermediate space, the intermediate component is an injectable material.

16. An electrical connector comprising:

a connector housing having a contact receiving space with a front opening and a rear opening, a sealing rib extending into the contact receiving space, and a guide rail;

a contact housing disposed in the contact receiving space and abutting the sealing rib;

an intermediate space formed between the contact housing and the connector housing and having a front portion and a rear portion delimited by the sealing rib, the guide rail extending into the intermediate space; and an intermediate component disposed in the rear portion of the intermediate space.

17. The electrical connector according to claim 16, wherein the guide rail of the connector housing extends into the sealing rib.

* * * * *